United States Patent [19]

Schacht

[11] Patent Number: 4,902,253

[45] Date of Patent: Feb. 20, 1990

[54] RE-TERMINATING INACCESSIBLE ALUMINUM CONDUCTORS

[76] Inventor: Ezra L. Schacht, 1620 W. Main St., Houston, Tex. 77006

[21] Appl. No.: 76,164

[22] Filed: Jul. 21, 1987

[51] Int. Cl.[4] ..... H01R 4/18

[52] U.S. Cl. ..... 439/877; 439/879; 439/881; 29/863

[58] Field of Search ..... 324/539; 29/750–752, 29/758, 863; 439/877–882

[56] References Cited

U.S. PATENT DOCUMENTS 3,325,885 6/1967 Ziegler et al. ..... 29/751

OTHER PUBLICATIONS

Hand Assembly Tool for Modular Plugs, Miller et al, Western Electric Tech. Dig. No. 53, p. 15 Jan. 1979.

*Primary Examiner*—Eugene F. Desmond

[57] ABSTRACT

A method, installation tool, termination fittings, and test apparatus, for mass-production retrofit of aluminum wiring systems installed in buildings from 1965 to 1973, when aluminum was approved by many inspection departments. The re-termination fittings are customized for mass production on the basis of the sizes (10, 12, etc.) of the existing wire, the required movement of which with this method is minimal, an important factor in view of its frangibility. The battery-operated portable tool solidly swages the fittings to one, two, or more wires. Connection is made to duplex receptacles, the most frequently encountered device, by copper stubs which engage with both screws of the same polarity, assuring that the re-termination fittings are thus firmly fixed to the receptacle, and minimum wire movement will be required. With the re-termination fittings and the method of conductor arrangement, the electrician's work is easier and faster.

4 Claims, 3 Drawing Sheets

60
61
62
111
113
100
90
91
110
80
75,76
142
40
20
89
82
81
20
112
18
72
71
112
79
88
78
70
142
141
18
4
4
81A
81B
40
20A
20B
141
503
72B
78B
78A
72A
75-76
141

320
322
323
321
327
326
324
325

(INCLUDES 3A,3B,3C)

304
305
307
306
301
302
300
303

502
500
501
20A
20B
141
72A
503
72B
40,41
42-45

RE-TERMINATING INACCESSIBLE ALUMINUM CONDUCTORS

BACKGROUND OF THE INVENTION

1. Field of the Invention

This invention pertains to the field of termination and splicing of electrical conductors, specifically solid aluminum conductors, as installed in buildings during the period from 1965 to 1973, but since then outlawed because of problems with terminations. Patents dealing with the splicing and termination of such conductors may be found in Class 339, subclass 276.

The patent classification definition which applies may be paraphrased as follows:

"Connectors, and terminations, under the class definition in which a solid conducting body is distorted in its solid state for securing a first conducting body to a second conducting body." (Emphasized phrases added by applicant.)

"(1) Note. In this subclass may be found, for example, devices in which novelty resides in the joint between a so-called 'solderless lug' and its associated conductor." (Page 339-37)

2. Description of Related Art

Problems with corrosion and of breakage of aluminum conductors are disclosed in U.S. Pat. Nos. 3,878,318 (Ziegler) and 3,956,823 (Kuo). Both inventions are elegant solutions for the problems discussed, but the problems posed in the re-termination of single solid aluminum conductors in residential wiring require a more specific and miniaturized apparatus and tooling, such as the present invention.

Likewise, other patents listed in the Information Disclosure Statement have an appearance similar to the present invention, but their size and inadaptability to the problems of the retrofit program seem to make them unrelated art.

THE STATE OF THE ALUMINUM-TO-COPPER WIRE RE-CONNECTION ART

It has become customary to retrofit in those wiring systems done some years ago with aluminum wire, the terminations of the aluminum wire with copper "pigtails." The cause of this massive retrofit is the potential fire hazard at terminations and connections of aluminum-to aluminum wire, and in particular, connections of aluminum conductors to receptacles in wall outlet boxes and in lighting fixture outlets.

At this time, in mid 1987, fire insurance companies are vigorously insisting on such retrofitting prior to renewing fire-protection policies.

A device and system acceptable to many of the insurance underwriters for terminating aluminum branch circuit conductors is the AMP Copalum System, a description of which is included with the references appended.

A versatile, powerful and expensive compressed-air tool is necessary to compress the ring around the aluminum conductors and the copper pigtail. The result is a flattened half-inch square-and bare—termination, from which the copper wire "pigtail" can be wrapped around the receptacle screw or connected to a fixture wire.

The AMP tool makes a 3/32" wire rectangular depression across the ⅜" width, on both sides of the flattened termination. If the crimp has been made too close to one end of the AMP ring, electricians say that the aluminum wire may break as it is pushed back into the outlet box. This can be a serious problem with "concealed" or "inaccessible" wiring.

Here are some pertinent definitions from the National Electrical Code.

DEFINITIONS

Accessible: (As applied to wiring methods.) Capable of being removed or exposed without damaging the building structure of finish, or not permanently closed in by the structure or finish of the building.

Concealed: Rendered "inaccessible" by the structure of the building.

Inaccessible: See concealed.

Because we wish to re-terminate "concealed" aluminum wiring, the importance of not breaking off any of the short wire ends at any outlet box is especially important. Electricians engaged in this work say that two unpredictable hazards contribute to high labor costs:

1. Wires have been overheated at the receptacle terminals, which causes the insulation to deteriorate, in effect shortening the usable wire, and 2. Breaking of the frangible wire, as a result of nicks, bends, and excessive and improper crimping with the AMP tool.

The AMP device is well designed to make a broad diversity of connections with various sizes and number of wires, from #12 to #6, and is furnished in two or three sizes diameters. It is perfect for work in service ducts and splice boxes, where a short broken wire end makes little difference.

The instant invention has an entirely different purpose and objective from that of such multi-purpose sleeves and compression tools as that made by the AMP Co. It was because applicant was asked by Houston electrical contractors to find an improved solution to this problem that the instant invention was developed.

The instant invention is specifically tailored to the connections of duplex receptacles wired with solid aluminum wire of sizes 10 and the like. By such specificity, in high volume applications, it is possible to eliminate some problems such as: the use of a heavy swaging tool, requiring compressed air-power, and use instead a light impact wrench, or possibly compound pliers, hand-operated compression tools, or battery-powered electric drivers.

It is, at this time, necessary to bring the massive air-operated AMP tool, trailing its compressed air hose through the building, around furniture to each wall receptacle, or lighting fixture outlet. After removing the plate and receptacle, the aluminum wires, usually two—one from the loadcenter and one continuing on to the next receptacle on the circuit—are inspected, the ends clipped and stripped. The two aluminum wire ends and the copper pigtail must be held by one hand in position within the barrel of the tubular connector while the heavy tool is held in the other. The loose assembly of ring and wire-ends is placed between the proper jaws of the compressed-air tool and the operating switch is activated.

As noted, the result is a flattened half-inch square—and bare—termination. After a piece of insulating tubing has been slipped over the connection, a heat gun is used to shrink it to a snug fit. Now the splice must be carefully pushed into the back of the box, which is time many of the breaks occur. The copper wire "pigtail" can then be wrapped around the receptacle screw or connected to a fixture wire.

Why does the electrician make every effort to avoid breaking the wire? If he does, it may be necessary to relocate the entire outlet box a few inches in the direction which will give him a little slack in the cable. An improved method is necessary if the massive re-termination effort in more than a million homes is to be completed at minimum cost to American home owners and electrical contractors.

Handling the heavy massive AMP tool, with its trailing air hose, requires the electrician to work on his knees for wall outlets, and to support the tool almost overhead while working on ceiling fixtures. There are many complaints about the difficulty of using this tool. It truly separates the men from the boys, in a physical sense.

SUMMARY OF THE INVENTION

All of such terminations in outlet boxes, which may number thousands in a large apartment complex, are virtually identical in aluminum wire size and type. That is, if the apartment complex was wired with No. 10 solid aluminum wire for combination lighting and non-appliance receptacle circuits, a terminating device in a receptacle or lighting fixture could be sized exclusively for the No. 10 solid aluminum conductor. Alternately, No. 12 aluminum may be used for the bedroom lighting circuits. It appears that these two sizes are the most common.

For this reason, in the present invention, a copper or copper-alloy workpiece, in the shape of a rectangular parallelopiped, has bored in it two holes slightly larger than the aluminum wires. For example for No. 10 solid aluminum wire of a nominal diameter of 0.102 inch, the bores are drilled with say, a number 36 bit, 0.1065 inch diameter. The holes for No. 12 solid wire with a diameter of 0.081 would be drilled with a number 44 drill, 0.086 inch diameter. Other sizes are in proportion. Although drilling is satisfactory for small volume projects, extrusion or other mass production techniques may be employed as production volume demands, without departing from the essence of this invention.

If the wire is relatively straight, has not been excessively overheated, kinked or nicked—the basic conditions for reuse—the wire will slip easily into the hole in the copper workpiece.

With such close tolerances, relatively light pressure is required to solidly fuse the aluminum wire into the copper matrix. Sections made with a milling cutter show how beautifully the two metals have formed to each other, assuring excellent contact with no possibility of oxide formation or loosening of contact.

In duplex receptacles, a contributing factor to the heat buildup which aggravates the problems with the aluminum conductor is the passage of the circuit current from the line conductor through the brass plate on the side of the receptacle through which the connecting screws are mounted. This brass plate seems undersized for the circuit currents encountered, especially in combination with the connected aluminum conductors.

Therefore, a copper link, or shunt, across the brass screw plate would result in cooler operation by reducing the heat generated in the brass strip and the screw contacts. Our workpiece performs this function, as well.

Further, if solid contact-could be made with the one or two aluminum conductors and the copper shunt, by relatively mild compressive force, the need for an expensive and heavy tool, complete with air compressor, could be avoided.

In addition, if the solid copper shunt could be fastened directly to the receptacle, it would require minimum insulation because there is less chance of contact between the connection and the metal box, or the other conductor of opposite polarity, in a box of insulated construction.

If the means of fastening the copper block could be the same screws (or rear-wall apertures for push-in terminations) which are integral with the receptacle, a simple and compact device would have been made available to the electricians doing the retrofit work, and less space is taken up by these devices in the box.

Slots and apertures for the reception of conductors are of course old in the art, as may be seen in Nillson (U.S. Pat. No. 2,964,585), but the parallel tap connector claimed for use with heavy stranded overhead conductors is not adaptable to the solid No. 12 and No. 10 conductors within outlet boxes, as is the compression of workpieces provided with them, but the improvements considered novel in the instant invention are:

1. Holes or slot-like apertures closely matched to the already-installed solid aluminum wire sizes.

2. For each receptacle already installed, a high-conductivity shunt, of copper or the like, to carry the portion of the circuit current required by those receptacles on the load side of that receptacle, limiting the heating in any receptacle to its own connected load.

3. Copper terminal pins, on center-spacing identical to that of the receptacle wire screws or that of the back-hole wire grips, so that the connector is firmly affixed to the receptacle, and no bare parts may come in contact with the outlet box or parts of opposite polarity. However a simple preformed insulator, or a "diaper" can be added with little installing time required, should the specific manufacturer's receptacle have metal parts too close to the connector of this invention.

4. A cordless impact-wrench, similar in size and mechanism to the Hitachi Model WH10D, can, by the special die means, apply pressure along lines parallel with the conductors through the block. This operation insures that the aluminum wires, which have been stripped of insulation just prior to insertion in the connector, are: 1. intimately embraced around their entire circumference within the copper block; 2. are indented by the chisel-like contour of the copper driven by the tool into the aluminum; and 3. have inspection means for indicating that the maximum proper pressure has been applied by embossing a marking to this effect on the surface of the copper block.

5. As an alternate to the copper terminal pins for use with receptacles, two tapped holes with binding head screws may be provided for the securing of fixture wires at fixture outlets—a great convenience when working overhead on ceiling fixtures.

6. A special effort is made to provide connector design and crimping means that reduce the possibility of breaking the frangible aluminum conductor, as shown in FIG. 4.

BEST MODE FOR CARRYING OUT THE INVENTION

Figure 1:
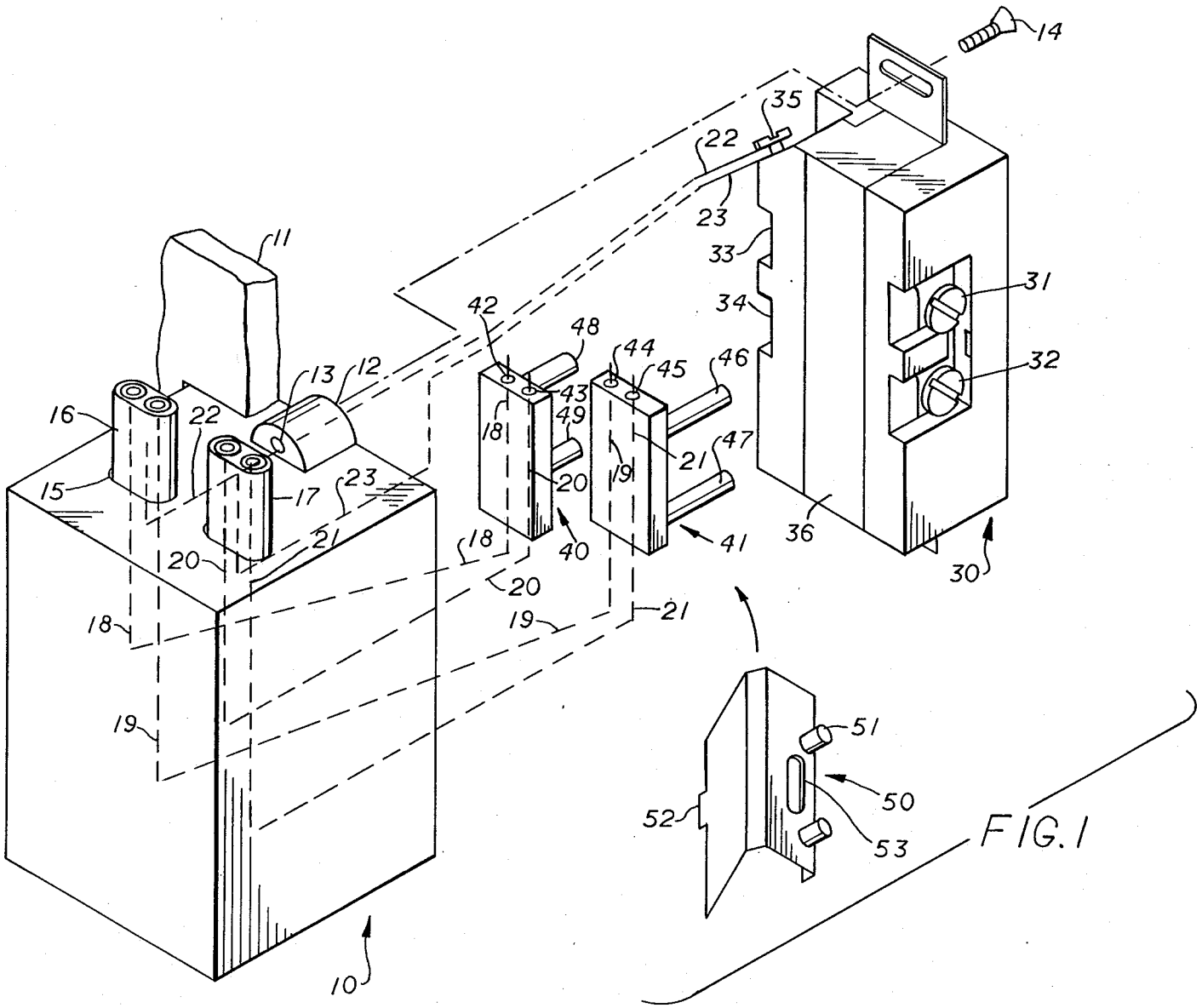
FIG. 1, an exploded view, shows pictorially and symbolically the method and apparatus of the present invention.

FIG. 1, an exploded view, shows pictorially and symbolically the method and apparatus of the present invention. On the left is duplex-receptacle outlet-box 10, which had been installed in the wall 11 at the time of construction. During that period, from the mid 1960's through the early 1970's, when the now-prohibited aluminum conductor was acceptable, many of these boxes 10 were made of a thermoset plastic. Molded concurrently with the box was the boss 12, threaded at through-hole 13, to receive one of the two receptacle-holding screws 14.

Entering box 10 at "knockouts" 15 are shown non-metallic sheathed cables (Romex) 16 and 17. Inside the box 10 the conductors 18 and 19 of cable 16, and conductors 20 and 21 of cable 17 are shown for simplicity as dashed lines, which have in the procedure of this method been removed from under conductor-fastening screws 31–34 (33 and 34 are on opposite side of receptacle and not shown).

Receptacle 30 is shown, for clarity, removed further from the box 10 than is necessary with this method. Receptacle 30 need only be brought out from box 10 far enough for access to terminal screws 31–34. The point is to minimize the amount of movement of the frangible insulated aluminum conductors 18–21, and the bare aluminum conductors 22 and 23, which terminate at grounding screw 35.

The electrician will, of course, be cognizant of the fragility of the existing aluminum wire. The method envisioned for use with this invention will bend the aluminum wire as little as possible. In most cases, it will not be necessary to bring the receptacle 30 more than an inch or so out of the outlet box, leaving the ground wires 22 and 23 connected to the receptacle at grounding screw 35.

The electrician, having detached the circuit wires 18–21 from the receptacle, will clip off the originally-stripped bent ends of wires 18–21, leaving only enough wire to connect to the terminal blocks 40 and 41. He will use a tool such as Ideal's E-Z Wire Stripper, to avoid nicking the bare aluminum wire at any point in the stripping operation. He will also make every effort to keep the stripped ends straight, so that they can easily enter, from either end of blocks 40 and 41, the bores 42–45 provided for them.

The electrician will let the ends of the conductors 18 and 20, and of 19 and 21 project an eighth of an inch beyond the blocks 40 and 41, to assure himself and the electrical inspector that the conductor is fully engaged within the block.

This slight extra projection also provides for a slight bend by pliers at the end of each, so that the conductor can be prevented from slipping out of the bore, should this be necessary. (Although the bores have been sized for the wires, there is clearance of a few thousandths of an inch.)

Figures 2, 2A:
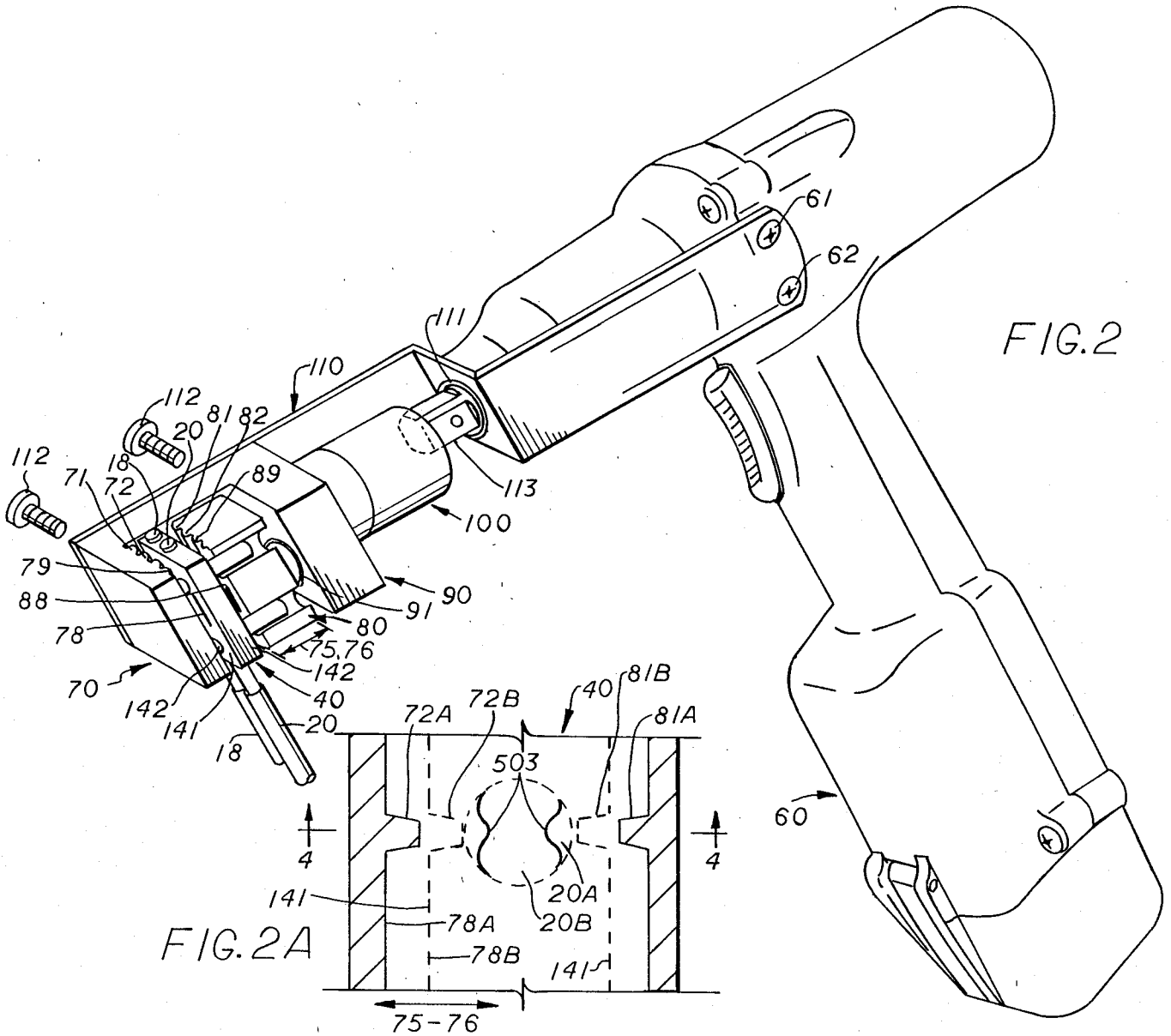
FIG. 2 shows pictorially the embodiment of the tool for the most rapid and efficient installation.
FIG. 2A, a crosssectional view, illustrates the result of repetitive impact. See also FIG. 5.

The tool and method of securing the conductors 18–21 within blocks 40 and 41 are shown in FIG. 2. Assume for the moment that the conductors 18–21 have been securely connected within the blocks 40 and 41.

Blocks 40 and 41 are each equipped, in this embodiment, with two copper studs or extensions 46 and 47, 48 and 49, capable of being secured easily under screws 31–32 and 33–34, as shown by dashed lines for block 41. Studs 48 and 49 engage with the similar screws 33–34 (not shown) of opposite polarity on the other side of receptacle 30. It will be of most importance that the electrician connect wires of the same polarity together in the blocks 40 and 41; that is, conductors 19 and 21, say to the neutral terminals, and 18 and 20 to the hot terminal, if this is correct. Otherwise, it may be necessary to cut both blocks loose and start again.

It will be noted that blocks 40 and 41 are thus firmly fixed to the receptacle 30. The location of the blocks 40 and 41 is thus predetermined by the location of the receptacle when it it pushed back into the box. There is no necessity to "dress" the wiring to the blocks, or from the blocks to the receptacle. It is also possible to accurately pre-gauge the lengths of wires 18–21, to strip them accurately, and then to crimp them for a solid connection.

If as noted, the outlet box 10 is of insulating material, no insulation may be required around blocks 40 and 41, unless there is possibility of contact with bare ground wires 22 and 23.

As has been noted, this system is intended for the mass re-termination of aluminum wiring in apartment complexes wired during the period 1965 to 1973 with aluminum conductor. The electrician will be required to determine that the receptacles that were installed are suitable for use with the apparatus and method shown in FIGS. 1–2. Some receptacles were manufactured with broad metal straps 36 covering virtually the complete back of the receptacle.

Such receptacles may require that blocks 40 and 41 be electrically isolated from such grounded parts as strap 33 by an insulating cover 50 or the like. Tubular extensions 51 can be added to partially sleeve and insulate studs 46–49 to comply with the National Electrical Code requirements on spacings. At the same time insulating cover 50 may be secured and locked around block 41 by tab 52 or similar device to avoid the necessity of the heatshrink operation conventionally used.

Alternately, the length of the folded insulation part 50 may be extended to assure that all required clearances are maintained.

An objective of this invention is to convert a tedious field operation into a mass-production procedure. The parts and tooling shown in the drawings may be adapted to specific wire sizes, center-to-center terminal screw distances, etc. Production quantities of the parts may then be delivered to the jobsite.

Nothing in the foregoing method is intended to prohibit the use of varied sizes of terminal blocks and bores for various wire sizes other than No. 12 or No. 10, or for receptacles and wiring devices with different terminal screw 31–32 center spacings. It is important to emphasize that customizing the parts for mass installations will effect the greatest economies with this method.

Having thus described the broad outlines of the method and apparatus of the invention, the embodiment of the tool for the most rapid and efficient installation is shown in FIG. 2.

A cordless impact-wrench 60, similar in size and mechanism to the Hitachi Model WH10D, can, by the die means 70, apply pressure along indenting rib-like projections 71–72 and 81–82, parallel and in alignment with the stripped conductors 18 and 20 (or 19 and 21)

through the movement of punch-block 80 in direction 75. This operation insures that the aluminum wires 18 and 20, which have been stripped of insulation and any surface oxide just prior to insertion in the connector 40, are: a. intimately embraced around their entire circumference within the copper terminal block 40; b. are indented by the chisel-like contour (see FIG. 2A) of the copper driven by the tool into the aluminum; and c. have inspection means for indicating that the maximum proper pressure has been applied by embossing on the surface of the copper block. markings 78 and 88 by shallow riblets 79 and 89, auxiliary to main ribs 71–72 and 81–82. An aperture 53 may be made in insulating wrapper 50 to provide for inspection of the embossed markings 78 and/or 88.

C-frame 90 serves as a support and a guide for the coacting punch and die parts previously described. It in turn is supported on a rigid bent strap 110 which links it to the impact driver 60. Aperture 111 centers and holds strap 110 in alignment with the ½" square drive of impact driver 60. Strap 60 is further secured by two screws 61 and 62 into the housing of the driver 60, these holes originally used for a carrying ring. At the other end of the strap, two screws 112 hold C-frame 90 securely in alignment with driver 60.

Coupling means 100 slidably link ½" square drive 113 with drive screw 91, limiting movement in directions 75 and 76, and optionally incorporating means for reversing the movement when the maximum desired depression in the copper or copper alloy block has been achieved.

It is not intended to exclude all other types of power- or hand-drivers for use in making the indentations, but for the wire sizes encountered in the aluminum retrofit program, and the copper thickness required in the block 40 and 41 walls, it is believed that no hand-operated tool with handles short enough to be used at a ceiling box or receptacle can compress the copper or copper alloy securely, and easily, around the aluminum conductor. Other power-drivers, such as the Ingersol-Rand ⅜" square impact tool, can do the job, but an electrical cord and 120 volt a.c. supply in required. The Hitachi Impact Tool has adequate battery power for the job. With the present state of the art in mid 1987, Milwaukee Tool dealers state that American manufacturers cannot match Japanese battery-powered devices at this time.

Furthermore, as detailed in FIG. 2A, the repetitive impact results in a beautiful half-inch long depression, 1/32 inch deep, with a base of some 0.030 inches in width, tapering to a crown of 0.020 inches, as an example.

The terminal block 40,41 is generally a rectangular parallelopiped, of copper or some suitable alloy. In the duplex-receptacle embodiment 40, (FIG. 2) through the broad face 141 have been made two holes 142, into which have been swaged two copper wire stubs 48,49 (FIG. 1). These stubs, of No. 10 or No. 12 hard drawn copper wire, have been placed on centers identical with those of the receptacle wire-holding screws 31–34. As has been noted, the screws firmly hold the block 40 (41) in place against the receptacle body 30 and provide excellent electrical contact.

Longitudinally through the block have been made two holes, slightly larger than the diameter of the aluminum conductors which will be secured therein. Note that, by proper spacing and drilling the holes for the stubs 48,49 first, press fitting the stubs before drilling the bores for the aluminum wires, it is possible to assure direct contact between the stubs and the aluminum wires as they cross each other, reducing the need for high conductivity in the terminal block 40, 41 itself.

The heavier wall section of terminal blocks 40, 41 at longitudinal edges 142 (FIG. 2) assures that there will be no yielding of the terminal block at the sides as the tool compresses the copper into intimate contact with the aluminum conductor.

A simple wrap-around preformed insulator 50 completes the connection. The entire assembly then can be pushed back into the box.

It may be necessary to customize the punch 80 and die 70 faces to the specific termination block requirements, and the termination block to the aluminum conductor.

It is common, at electrical supply houses, to find a range of wire sizes for small manufacturing tubular compressible connectors, say #12–10, or #22–16, with the warning that only copper conductors may be terminated therein. The implication is that future deformation ("creep") and oxidation of aluminum conductors may take place in such connectors. Copper, or the alloy used in the connector, will remain stable over time, as will the copper conductor. Therefore, a range of wire sizes may be handled by one connector size. There will obviously be "air pockets" or voids in such terminations.

In the instant invention, a block of copper, or the like, has bored therethrough holes so closely fitted to the aluminum conductors, that virtually "slidable" engagement is achieved. The "deoxidized" or cleaned aluminum conductors enter these holes, which themselves have been protected from atmospheric corrosion by packaging the terminals in that protective paper used to keep shipments of busbar untarnished, or by some form of plating. Now, over the length that such solid connection is specified, say one-half inch, the copper is compressed, as it were, by a chisel tip driven against a line (not a point) on the circumference of the aluminum conductor. As shown in FIG. 2A, the copper is swaged into areas **20*a*, and the aluminum conductor 20 compressed into the area 20*b*. ( Note that the broad area of commingling of copper and aluminum is shown as line 503 in FIGS. 2 and 4**.) The clearance space of the void around the solid conductor is reduced, until there is virtually a continuous contact between copper block and circumference of aluminum conductor. Examination under the microscope shows mingling of the two materials in the boundary area. There is no path for corrosion to enter, nor room for the aluminum to escape the embrace of the copper matrix in which it is gripped.

Further, the two indentations **20*a* assure that there will be no rotation of the aluminum conductor in the connector, as the connector is turned and twisted, when the receptacle 30 is returned to the box. Also, there is a little countersunk clearance at both ends of the connector (shown in FIG. 4 as 502**, for a fraction of an inch. This helps to prevent breaking of the relatively brittle aluminum conductor as it is pushed back into the box.

A single indentation in one side of the copper block will deform the the solid aluminum conductor at the point or area of contact. In tests, however, by bending the aluminum conductor adjacent to the block at a right angle to its position within the block, it is possible to apply enough torque by hand to the conductor within the block to further "deform" and loosen the conductor, especially if the torque is applied alternately in clockwise and counterclockwise directions. The soft aluminum yields under the hand-applied pressure. The resultant "rocking" back and forth of the conductor is readily detectable.

However, if two indentations 72*a* and 81*b* are made on opposite sides of the block as disclosed in the present invention, the solid aluminum conductor, in the sizes 10 and 12 most commonly encountered, will not be "deformed by rocking", will remain fixed within the bore of the block, and in fact, may be twisted off outside the block before there is any loosening within the block.

Note also that small punch section 78*a*, with a height of 0.005 inch, serves to provide an "inspector's fine-line" indication at 78*b* to confirm that the main punches 72 and 81 have been fully seated.

Figures 3, 3A, 3B, 3C, 4:
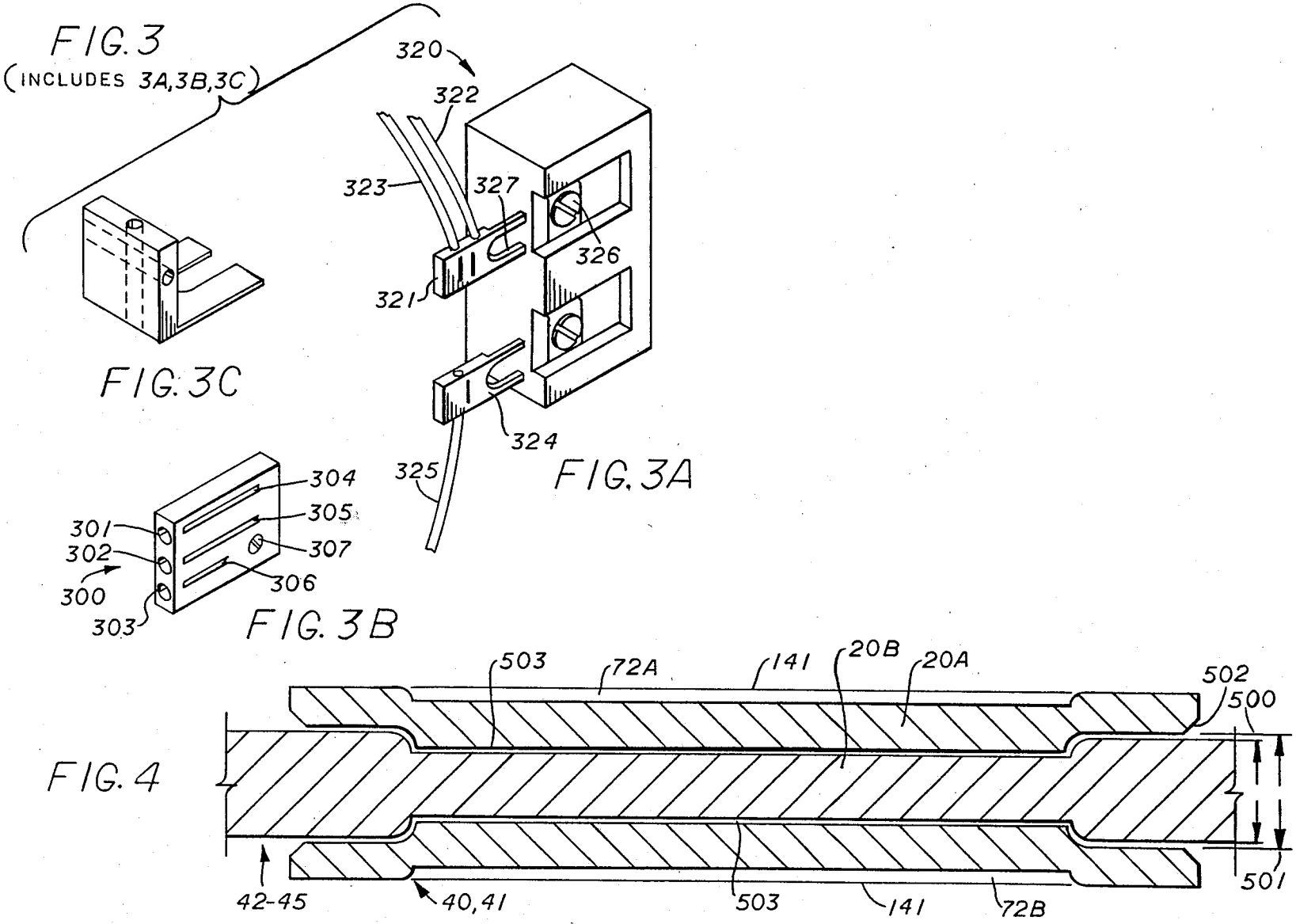
In FIGS. 3*a*, 3*b*, and 3*c*, other forms of the aluminum wire terminating device are shown.
In FIG. 4 is shown a magnified cross section 2—2 of FIG. 2*a* of the connector, through the ribs, illustrating its anti-frangibility features. Scale is 10:1.

FIG. 4, a 10:1 magnified cross sectional view of connector or re-termination block 40, 41, is Section 2—2 of FIG. 2A, and attempts to illustrate the anti-frangibility feature. Although intimate and mingled contact occurs at intersection of copper 20*a* and aluminum wire 20*b*, for an effective bond, the die ribs 72*a* and 81*a* do not cover the full length of the connector 40–41. Thus for a distance based upon requirements, at each end of connector 40 and 41, there remains a small clearance (501 minus 500), a few thousandths of an inch, as provided in the drilling or extrusion process discussed earlier in this disclosure. This clearance now permits the conductor to move slightly without restriction, an anti-frangibility feature further enhanced by the countersink 502 at each end of the connector 40,41. Conductors 42–45 thus seem well protected against damage from turning or bending of the wire as it may occur.

In contrast, in the AMP device, the indentation across the re-termination fitting, if close to one end of the fitting, may serve as a fulcrum to accentuate the frangibility of the aluminum wire.

The three locations in which the present invention will be most commonly used are the: (1) wall receptacle, (2) wall switch and (3) ceiling-or-wall lighting-fixture or junction-box. The embodiment of the termination for receptacles has been shown in FIGS. 1 and 2.

Other forms of the aluminum wire terminating device are shown in FIGS. 3*a*, 3*b*, and 3*c*.

The switch embodiment is shown as FIG. 3*a*. As shown, switch 320 maybe connected to hot line 322 through connector block 321, and a spade terminal 327 secured under the hot switch screw terminal 326. At the same time, continuation of hot line 323 may be swaged into the second hole in block 321.

Lighting-fixture outlet box termination 300 may have three bores 301–303, and if all are used for neutrals, they may be crimped at one time with tool 60 at 304–307. One bore 306 may be cross-tapped for a setscrew 307, which may be used for the fixture lead wire.

FIG. 3*c* shows an alternate type of connector for use with switches and the like.

What I claim:

1. An electrical connector for re-terminating at least one previously installed solid aluminum conductor, of the type now outlawed, at a pair of conductor-securing screws, of the same polarity, of a duplex-receptacle, the connector comprising:

a block of electrically high-conductive material, in the general shape of a rectangular parallelopiped, having a front, a back, a top, bottom, and two sides;

stub-like electrical conductors, integral with said block, on centers equivalent to those of said receptacle screws, projecting perpendicularly from said front, said stubs of a length suitable for securing said block to said receptacle, when each of said stubs is engaged with one of said screws;

said parallelopiped having at least one cylindrical bore, from top to bottom of the block, said bore slightly larger than the diameter of said previously-installed conductor, now to be installed therein; and said block being positioned within retaining means and indentable from said front and said back, in chisel-tip fashion along a predetermined length of said conductor, said chisel tips in centered alignment with said conductor, into intimate contact with the entire surface of said conductor, and further indenting cylindrical surface of said conductor into a figure-eight like cross-sectional area, said indentations acting as a couple to prevent rotation of said aluminum conductor within said bore of said connector block.

2. A connector block as recited in claim 1, in which said stub-like electrical conductors are spaced as forked spade-like terminations for engagement under single wire-binding heads of said receptacle screws and other wiring-device wire-holding screws.

3. A connector according to claim 1 further including an insulative cover, the cover having tubular extensions for at least partial sleeving of said stub-like electrical conductors, and a window for inspection of "inspector's fine line" on said block.

4. A method of re-terminating, in insulative outlet boxes, existing installed old-technology solid-aluminum wire circuit connections, under the screw heads of existing receptacles, by use of:

(a) connector blocks of electrically high-conductive material, in the general shape of rectangular parallelopipeds, having a front, a back, a top, a bottom, and two sides;

stub-like electrical conductors, integral with said block, on centers equivalent to those of said receptacle screws, projecting perpendicularly from said front, said stubs of a length suitable for securing said block of said receptacle, when each of said stubs is engaged with one of said screws;

said parallelopiped having at least two cylindrical bores, from top to bottom of the block, said bores slightly larger than the diameter of said previously-installed old-technology conductors, now to be installed therein; and (b) an apparatus for swaging said electrical terminal connectors of highly-conductive material onto solid aluminum electrical conductors, the device comprising in combination:

impact driving means, and a pair of coacting jaws having swaging means;

the steps of the method comprising:

moving said receptacle so short a distance out of the outlet box that said wires connected to said receptacles need not be disconnected nor damaged by said movement;

detaching from screws, clipping, stripping straightening, and deoxiding stripped ends of said aluminum circuit wires;

rotating said wire ends only through a slight angle and entering straight ends into said connector bores;

securing said wire ends within said termination blocks by said impact means, working close to front plane of said outlet box;

moving aluminum wires terminated in said blocks through a small angle until perpendicular stubs of said connector blocks are aligned with plane of said receptacle screw-heads;

securing said stubs under said installed screw binding heads; and returning said receptacle to its original position within said insulative outlet box.

* * * * *